United States Patent [19]

Studebaker

[11] 4,423,906

[45] Jan. 3, 1984

[54] METHOD OF FORMING AN IN SITU OIL SHALE RETORT

[75] Inventor: Irving G. Studebaker, Grand Junction, Colo.

[73] Assignee: Occidental Oil Shale, Inc., Grand Junction, Colo.

[21] Appl. No.: 837,521

[22] Filed: Sep. 29, 1977

[51] Int. Cl.[3] ..... E21C 41/10

[52] U.S. Cl. ..... 299/2; 299/13; 299/19

[58] Field of Search ..... 299/2, 13, 19; 166/259

[56] References Cited

U.S. PATENT DOCUMENTS 4,043,596 8/1977 Ridley ..... 299/13

OTHER PUBLICATIONS

Agapito, Pillar Design in Competent Bedded Formations, Thesis for Colorado School of Mines, 1972.

Sellers et al., Rock Mechanics Research on Oil Shale Mining, presented at AIME Annual Meeting, 1971.

W. S. Boulton, *Practical Coal Mining,* Grehsam Pub. Co., London (1908) vol. 1, pp. 10–14; vol. 2 pp. 304–312.

T. H. Cockin, *Coal Mining,* Lockwood & Son, Ludgate Hill, England, (1904) pp. 148–150 and 160–162.

Daniel Burns, *The Elements of Coal Mining,* Edward Arnold Pub., London (1917) p. 72.

Mining Engineer's Hndbk., Peele, ed., 3rd ed. vol. 1, pp. 477,478, 1959 John Willey & Sons, N.Y.

*Primary Examiner*—William F. Pate, III

*Attorney, Agent, or Firm*—Christie, Parker & Hale

[57] ABSTRACT

An in situ oil shale retort is formed in a subterranean formation containing oil shale and having a substantially vertically extending first cleavage plane set and a substantially vertically extending second cleavage plane set intersecting the first set. The dispersion of the individual cleavage planes in the first and second cleavage plane sets is determined. The in situ retort is formed by excavating a vertical slot-shaped void within the boundaries of the retort site, leaving a remaining portion of the unfragmented formation within the retort site which is to be explosively expanded toward the slot. The unfragmented formation adjacent the slot has a pair of longer vertical free faces substantially aligned with the cleavage plane set having the lower dispersion. A pair of shorter vertical side walls of the slot can extend substantially perpendicular to the cleavage plane set having the lower dispersion. Explosive placed in such remaining formation adjacent the slot is detonated to fracture formation along cleavage planes in the first and second cleavage plane sets and to expand such remaining formation within the retort site toward the slot, forming a fragmented permeable mass of formation particles containing oil shale within the retort site.

22 Claims, 9 Drawing Figures

⊙ JOINTS OVER 10 FEET LOCATED IN CLEAVAGE PLANE SET
△ OTHER CLEAVAGE PLANES OVER 10 FEET

METHOD OF FORMING AN IN SITU OIL SHALE RETORT

BACKGROUND OF THE INVENTION

This invention relates to in situ recovery of shale oil and, more particularly, to techniques for facilitating the formation of an in situ oil shale retort.

The term "oil shale" as used in the industry is in fact a misnomer; it is neither shale, nor does it contain oil. It is a sedimentary formation comprising marlstone deposit with layers containing an organic polymer called "kerogen" which upon heating decomposes to produce hydrocarbon liquid and gaseous products. The formation containing kerogen is called "oil shale" herein, and the hydrocarbon liquid product is called "shale oil".

One method for recoverng shale oil is to form an in situ retort in a subterranean formation containing oil shale. Formation within an in situ retort site is explosively expanded to form a fragmented permeable mass of formation particles containing oil shale.

The fragmented mass is ignited near its top to establish a combustion zone. An oxygen-containing gas is introduced at the top of the fragmented mass to sustain the combustion zone and to advance it downwardly through the fragmented mass. As burning proceeds the heat of combustion is transferred to the fragmented mass below the combustion zone to release shale oil and gaseous products from the fragmented mass in a retorting zone. Thus, a retorting zone moves from top to bottom of the fragmented mass in advance of the combustion zone, and the shale oil and gaseous products produced from retorting pass to the bottom of the fragmented mass for collection and removal.

In preparation for retorting it is important that the formation containing oil shale be fragmented, rather than simply fractured, to create sufficient permeability that undue pressures are not required to pass the gases through the fragmented mass. The prior art provides techniques for fragmenting a substantial volume of formation containing oil shale to form a fragmented permeable mass in an in situ oil shale retort. For example, techniques for forming an in situ oil shale retort are disclosed in U.S. patent application Ser. No. 790,350, entitled "In Situ Oil Shale Retort With A Horizontal Sill Pillar", filed Apr. 25, 1977, by Ned M. Hutchins; and U.S. Pat. No. 4,043,596 entitled "Forming Shale Oil Recovery Retort By Blasting Into Slot-Slot-Shaped Columnar Void". This application and patent are assigned to the same assignee of the present application and are incorporated herein by this reference.

Application Ser. No. 790,350 describes an in situ oil shale retort formed in a subterranean formation containing oil shale by excavating a columnar void having a vertically extending free face, drilling blasting holes adjacent the columnar void and parallel to the free face, loading explosive into the blasting holes, and detonating the explosive to expand the formation adjacent the columnar void toward the free face. In one embodiment the void is a slot having large parallel planar vertical free faces toward which formation in the retort volume is explosively expanded. In such an embodiment the blasting holes are preferably arranged parallel to the free faces.

Once such a vertical slot is formed, it stands open while workers prepare for blasting the remaining unfragmented formation within the retort site. Such a vertical slot in one embodiment has side walls which are about 120 feet wide and over 200 feet high. It is desirable that a vertical slot with side walls of such height be formed so that the side walls remain as stable as possible while the vertical slot remains open. Any undue breakage or sloughing of the side walls into the bottom of the slot can adversely affect explosive expansion and retorting operations. For example, if failure of the walls in the slot causes substantial sloughing or slabbing of the walls into the lower portion of the slot, an uninterrupted free face is not available in the lower portion of the vertical slot toward which the remaining formation in the retort site can be explosively expanded. This can inhibit desired fragmentation of formation in the lower portion of the retort site upon subsequent explosive expansion.

Further, failure of the walls of the slot and consequent widening of the slot can adversely affect the resulting void volume of the fragmented mass following explosive expansion. It is desirable that gas flow through the fragmented mass be as uniform as possible in order to maximize the yield of products from the fragmented mass. Failure of the walls of the slot, which can result in substantial non-uniformities in void volume distribution, and can reduce the product yield of the retort.

SUMMARY OF THE INVENTION

This invention concerns formation of an in situ oil shale retort in a subterraean formation containing oil shale and having a substantially vertically extending first cleavage plane set and a substantially vertically extending second cleavage plane set intersecting the first cleavage plane set. The dispersion of the cleavage planes in the first cleavage plane set and in the second cleavage plane set is determined. Formation is excavated to form a vertically-extending slot having relatively longer side walls and relatively shorter end walls, leaving a remaining portion of unfragmented formation within the boundaries of the in situ retort being formed. The relatively longer side walls are aligned with the cleavage plane set having the lower dispersion. At least a part of the remaining portion of the formation within the retort site is explosively expanded toward such a slot to form a fragmented permeable mass of formation particles containing oil shale within the retort site.

According to another aspect of the invention, the slot is formed in a subterranean formation containing oil shale and having a substantially vertically extending principal cleavage plane set and a substantially vertically extending secondary cleavage plane set approximately orthogonal to the principal cleavage plane set. Formation is excavated to form a vertical slot, with unfragmented formation adjacent the slot having a pair of longer free faces substantially parallel to the secondary cleavage plane set and a pair of shorter free faces substantially parallel to the principal cleavage plane set. At least a part of the remaining portion of the unfragmented formation within the retort site is explosively expanded toward such a free face for forming a fragmented permeable mass of formation particles in the in situ retort.

By aligning the longer walls of the slot with such a cleavage plane set, it has been discovered that the long term stability of such walls is improved when compared with a slot oriented so that its longer walls are not aligned with such a cleavage plane set in a formation containing oil shale.

DRAWINGS

Features of specific embodiments of the invention are illustrated in the drawings, in which.

DETAILED DESCRIPTION

Figure 1:
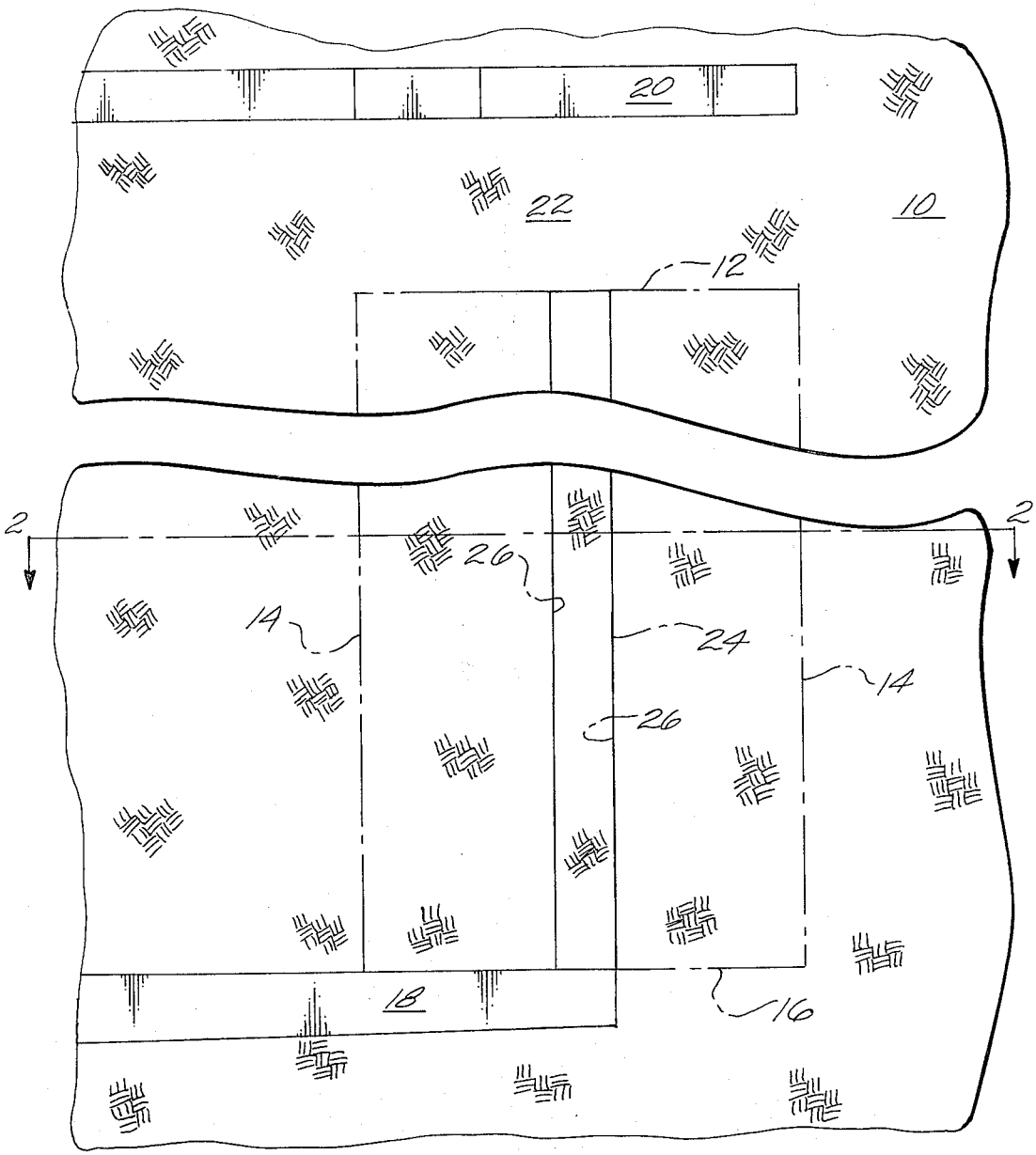
FIG. 1 is a semi-schematic cross-sectional side view taken on line 1—1 of FIG. 2 and showing a portion of a subterranean formation containing oil shale during preparation of an in situ oil shale retort.
Figure 2:
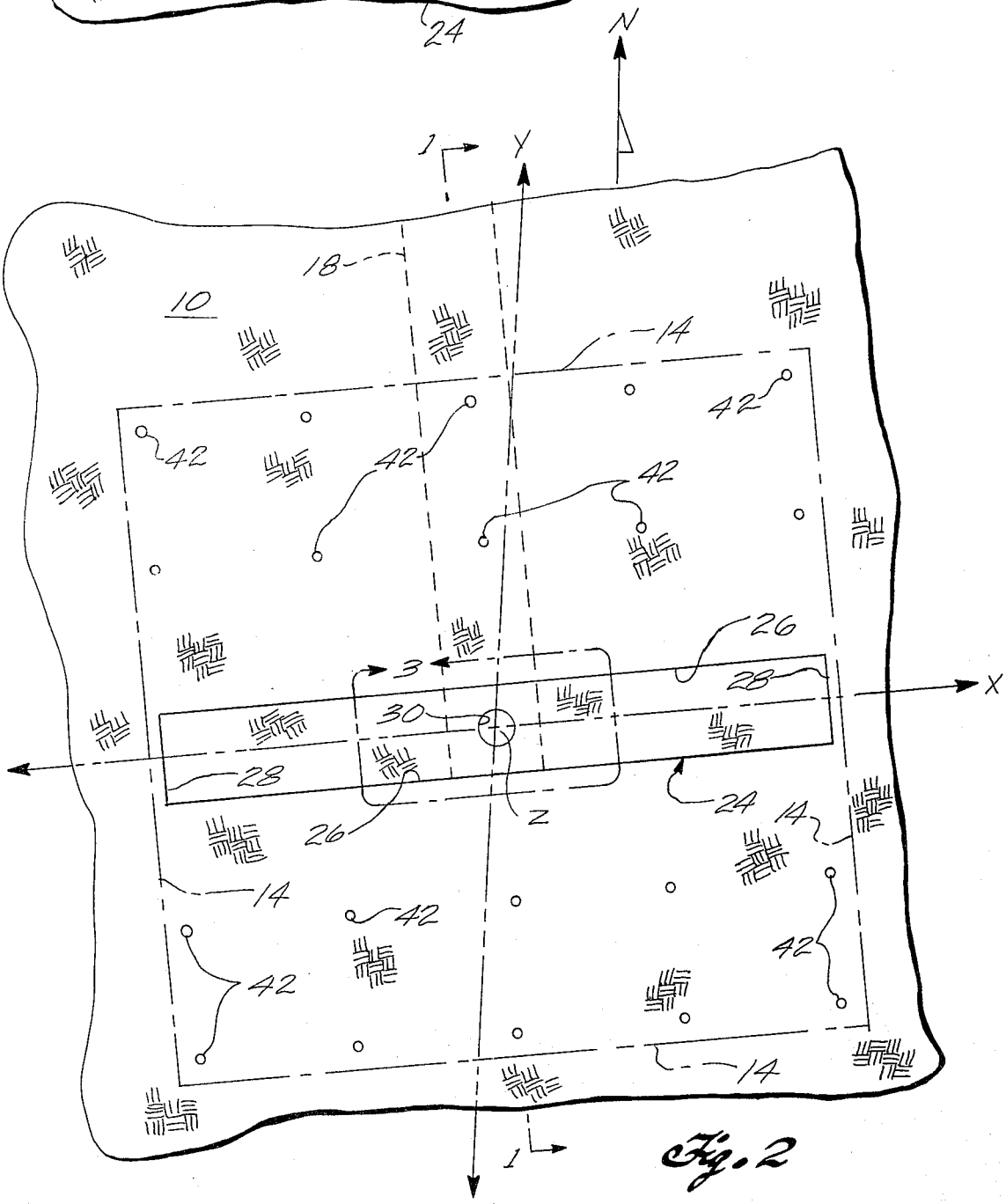
FIG. 2 is a cross-sectional plane view taken on line 2—2 of FIG. 1, in which the view shown in FIG. 2 is rotated relative to that shown in FIG. 1 so that the North bearing or azimuth will extend vertically in FIG. 2.

FIGS. 1 and 2 show a subterranean formation 10 containing oil shale in which an in situ oil shale retort is being formed. The in situ retort shown in FIGS. 1 and 2 is rectangular in horizontal cross section, and as shown in phantom lines in FIG. 1, the retort being formed has a top boundary 12, four vertically extending side boundaries 14, and a lower boundary 16. A drift 18 at a production level provides a means for access to the lower boundary of the in situ oil shale retort. Formation which is excavated to form the drift 18 is transported to above ground through an adit or shaft (not shown).

A method of forming the in situ retort shown in the drawings comprises excavating a portion of the formation to form an open base of operation 20 on an upper working level. The floor of the base of operation 20 is spaced above the upper boundary 12 of the retort being formed, leaving a horizontal sill pillar 22 of unfragmented formation between the bottom of the base of operation and the upper boundary of the retort being formed. The horizontal extent of the base of operation 20 is sufficient to provide effective access to substantially the entire horizontal cross section of the retort being formed. Roof-supporting pillars can be left on the working level base of operation in a portion of the area directly above the retort being formed. Such a base of operation facilitates excavation operations for forming a void and drilling and explosive loading for explosive expanding of formation toward such a void to form a fragmented mass of particles in the retort being formed. The open base of operation also facilitates introduction of oxygen-containing gas into the top of the retort formed below the horizontal sill pillar 22. Formation is excavated from the formation 10 so that the base of operation 20 has side walls substantially aligned with orthogonal cleavage plane sets extending through the formation.

In preparing the in situ retort, a vertical slot-shaped void 24, herein referred to as a slot, is excavated from within the boundaries of the retort site. This leaves a remaining portion of unfragmented formation within the boundaries of the retort site which is to be explosively expanded toward the slot. Unfragmented formation defining the side walls of the slot provides parallel free faces toward which the remaining unfragmented formation within the boundaries of the retort site is explosively expanded to form a fragmented permeable mass of formation particles containing oil shale within the completed retort. The vertical slot 24 extends upwardly from the production level access drift 18 to the upper boundary 12 of the retort being formed. The length of the slot, when viewed in plan view as in FIG. 2, extends essentially the entire distance between the opposite side walls 14 of the retort being formed. The slot is located within the side boundaries of the retort so that the long direction of the slot extends across the center of the horizontal cross section of the retort being formed. FIG. 1 illustrates the width, or narrow dimension, of the slot being located essentially in the center of the boundaries defining the retort being formed. In the embodiment shown, the slot is over 120 feet in length and about 18 feet wide. The slot is over 200 feet in height and provides a void fraction of about 15% in the fragmented permeable mass of formation particles formed within the completed retort.

A number of formations containing oil shale have horizontal cleavage planes extending substantially parallel to the lower boundary of the formation, as well as vertical cleavage planes extending substantially perpendicular to the lower boundary of the formation. Generally, vertical cleavage planes occur in sets, with individual cleavage planes within a given set being substantially parallel to one another. There are generally two or three sets of vertical cleavage planes extending through formations containing oil shale, with one set of vertical cleavage planes intersecting another set. For the purposes of illustration, it will be assumed that the formation 10 contains first and second sets of vertical cleavage planes extending at about right angles to one another. Designating a horizontal X-axis and a horizontal Y-axis extending through the formation parallel to the lower boundary of the formation and a vertical Z-axis extending perpendicular to the lower boundary of the formation, as shown in FIG. 2, the cleavage planes are substantially parallel to the planes passing through the formation and intersecting the X-Z, Y-Z, and X-Y axes, respectively. In the embodiment shown in the drawings the X and Y, and X and Z, and the Y and Z axes are approximately orthogonal to each other. The X and Y axes are illustrated a few degrees from a right angle since this is commonly found in the oil shale formations of the Piceance Creek Basin in Colorado. A north arrow is also indicated on FIG. 2 to show the azimuth or bearing of the strike of cleavage planes sets in one example of oil shale formation. Strike is the direction or bearing of a horizontal line in the plane of an inclined stratum, joint, fault, cleavage plane, or other structural plane. In the illustration in FIG. 2, the strike of the Y-Z cleavage plane set is approximately North.

The strike of the X-Z cleavage plane set is a few degrees northeast of East.

The formation breaks much easier along the cleavage planes than along other planes extending through the formation 10. Cleavage plane is defined in *A Dictionary of Mining, Mineral and Related Terms,* U.S. Dept. of Interior, 1968, as "any uniform joint, crack or change in quality of formation along which rock will break easily when dug or blasted." For example, when formation is excavated to form the production level drift 18, formation at the side walls of the drift tends to break along the vertical cleavage planes. As a further example, the side boundaries 14 of the retort being formed can be aligned with the substantially orthogonal vertical cleavage plane sets so that the formation will preferentially fracture along cleavage planes in such vertical cleavage plane set when forming the side walls of the retort.

A method for forming an in situ oil shale retort having side walls aligned with vertical cleavage planes is described in application Ser. No. 563,607, filed Mar. 31, 1975, and a corresponding continuation-in-part application Ser. No. 834,464, filed Sept. 19, 1977, by Richard D. Ridley and entitled "In Situ Recovery of Shale Oil". These applications are assigned to the same assignee of this application and are incorporated herein by this reference. These applications describe how the orientations of the vertical cleavage planes are determined in preparation for aligning the side walls of the retort with such cleavage planes.

The cleavage planes of subterranean formations containing oil shale are natural secondary structures which are generally developed by pressure which allow the formation to be more easily split along the cleavage planes than along other planes. The cleavage planes within a given cleavage plane set are closely spaced through the formation. For example, in an extensive oil shale formation in the Piceance Basin of Colorado, one cleavage plane set is almost horizontal and extends parallel to the lower boundary of the formation, and two other cleavage plane sets are almost vertical and extend substantially perpendicular to the lower boundary of the formation. The dip of these formations is almost entirely less than about 3 degrees, although areas with a higher dip are known. Dip is the angle at which a cleavage plane set is inclined from the horizontal. It is perpendicular to strike. The vertical cleavage planes can, therefore, tilt slightly, but are substantially vertical. Generally they are close enough to vertical that substantially vertical blasting holes are satisfactory for preferentially fragmenting the formation to form side walls aligned with the vertical cleavage planes.

Cleavage planes are not always visible in a formation containing oil shale. They are merely planes of weakness along which the formation has a lower strength than in planes extending in other directions. It therefore takes less stress to fragment the formation on a plane parallel to the cleavage plane system, and most fractures induced in the formation are aligned with the cleavage plane sets. The principal directions of the cleavage planes can be determined by statistical analysis as mining is conducted. Thus, for example, as a drift is excavated from an outcropping into a subterranean formation containing oil shale, the walls of the drift have rock protrusions, many of which have substantially planar faces. The azimuth of a number of these planar faces is determined, and it is found through statistical analyes that the greater number of such faces are aligned with cleavage planes of the formation. The principal cleavage planes also can be determined by surface mapping of cleavages in outcroppings, or by analyses of core samples. The individual in situ oil shale retorts formed in a formation containing oil shale can be aligned with the cleavage planes once the orientations of the cleavage planes are determined by such statistic analysis.

In practice of an embodiment of the present invention, formation is excavated from the retort site to form the slot 24 so that its relatively longer side walls 26 are aligned with, i.e., extending substantially parallel to, one of the vertical cleavage plane sets extending through the formation.

The actual cleavage planes in the formation are not precisely parallel with each other There is some angular dispersion of cleavage planes from the nominal dip and strike of the cleavage plane set having a North strike, that is, a bearing of zero degrees. The individual cleavage planes in that set can have a strike within a band extending ten degrees or so on each side of the nominal strike of the cleavage plane set. Greater or lesser angular dispersions of cleavage planes within a cleavage plane set can occur. The strike of the cleavage plane set is considered to be the average of the cleavage planes in the set. Similarly, there can be dispersion in the dip of cleavage planes in a cleavage plane set.

When two or more vertically extending cleavage plane sets are present in a formation, one can be designated as a principal cleavage plane set or fracture set and the other as a secondary cleavage plane or fracture set. A third minor cleavage plane set is sometimes found in oil shale formations. The principal cleavage plane set is characterized by a relatively larger number and/or extent of fractures as compared with the number and/or extent of fractures in the secondary cleavage plane set.

In an embodiment of practice of this invention, a slot-shaped void is excavated in the formation leaving a remaining portion of unfragmented formation within the boundaries of the in situ retort being formed. The surfaces of the remaining formation define larger free faces on opposite sides of the slot. These longer free faces are substantially parallel to the secondary cleavage plane set in the formation containing oil shale. The shorter walls of the slot are substantially parallel to the principal cleavage set. It is advantageous to have the principal cleavage plane set perpendicular to the larger free faces of the slot.

It also is desirable that the larger free faces of unfragmented formation adjacent the slot be arranged perpendicular to the cleavage plane set having the greatest dispersion of strike and/or dip or parallel to the cleavage plane set having lower angular dispersion. Such orientation of the slot minimizes sloughing of unfragmented formation from the larger free faces into the open slot.

Figure 4:
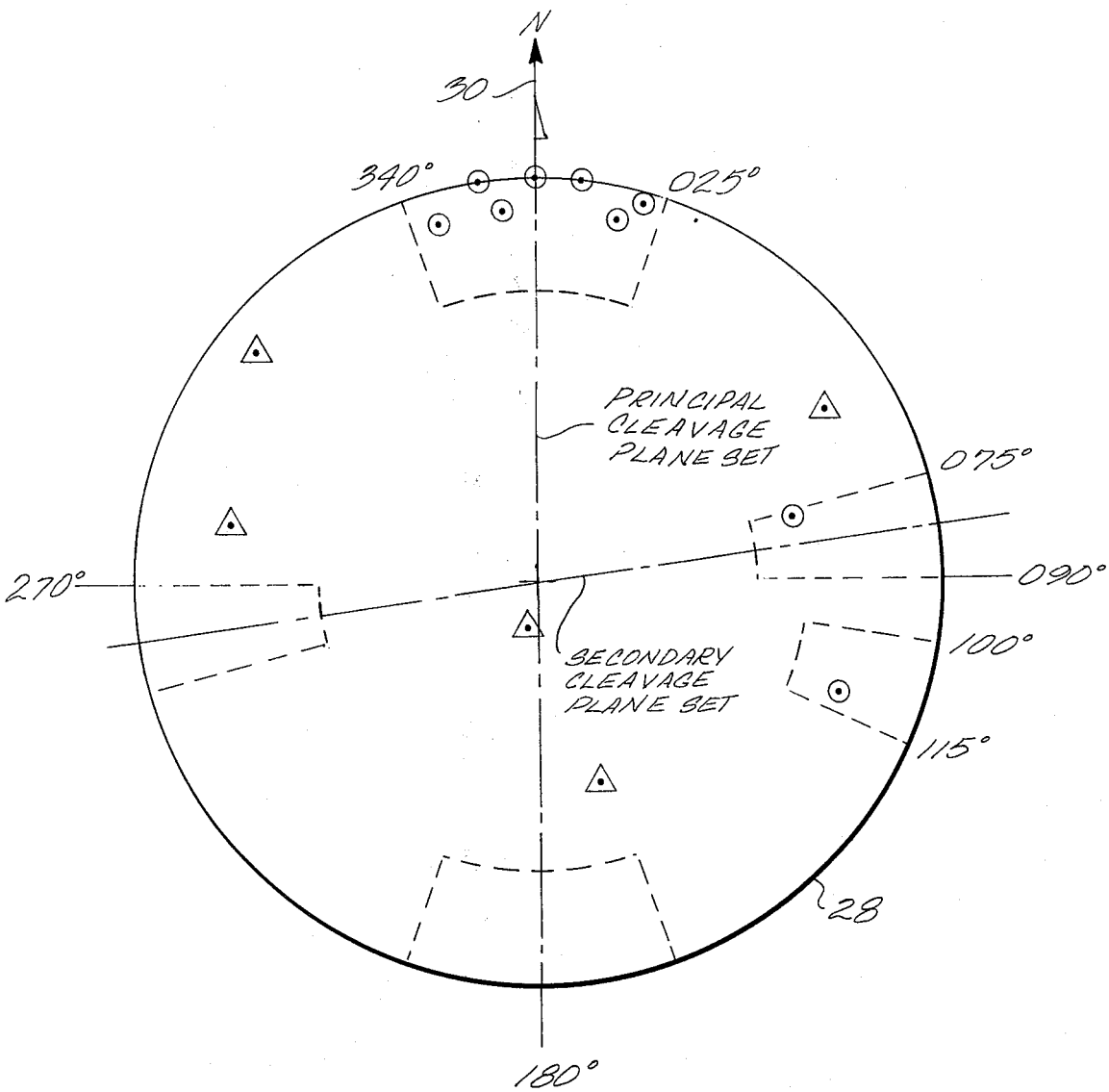
FIG. 4 is a cleavage plane set diagram for determining principal and secondary cleavage plane sets in a subterranean formation containing oil shale.

The orientation of the slot 24 with respect to the vertical cleavage plane sets is determined after the formation has been analyzed to determine the orientations of the principal and secondary vertical cleavage plane sets present in the formation, and to determine the dispersions of individual cleavage planes within each cleavage plane set. FIG. 4 is a generalized fracture set diagram which helps illustrate a technique for determining the principal and secondary cleavage plane sets. The fracture set diagram is prepared from analyses of formation samples or mine surveys to determine such principal and secondary cleavage plane sets. FIG. 4 indicates the strike and dip of significant cleavage plane sets noted in excavations in the oil shale formation at Logan Wash in the southwest part of the Piceance Creek Basin, north of DeBeque, Colorado, where an experimental in situ oil shale retort similar to that shown in the drawings was prepared. The diagram indicates the orientation of cleavage planes in the formation at the Logan Wash site.

Data for constructing the fracture set diagram was obtained from surveying exposed fracture faces in excavated portions of the formation containing oil shale. Substantially flat fracture faces on the walls of excavated spaces (such as drifts) were surveyed to determine their strike and dip. When the orientations of a number of such fracture faces are plotted on a fracture set diagram, the strike and dip of the cleavage plane sets in the formation become apparent.

The fracture set diagram shown in FIG. 4 is in the form of a circle 28 with azimuth, or bearing, portrayed around the circumference of the circle, with north at the top, as illustrated by the arrow 30, east at the right, south at the bottom, and west at the left. The strike of the surveyed cleavage planes is plotted at the appropriate azimuthal location. The dip of the cleavage planes is indicated by radial position, with zero degrees dip, or horizontal, being in the center of the circle and 90 degrees dip or vertical being on the periphery. A few cleavage planes larger than about ten feet in length are plotted on the fracture set diagram shown in FIG. 4. A large number of smaller cleavage planes also were plotted in forming the fracture set diagram, but they are not individually illustrated in FIG. 4.

The measured data for forming the fracture set diagram for the formation at the Logan Wash site indicated that a principal cleavage plane set exists with a dip of nearly 90 degrees at an azimuth between about 340 degrees and 25 degrees, as indicated by the dashed lines indicating the band of dispersion. Most of the cleavage plane surveyed, including many of the principal cleavage planes plotted in FIG. 4, were in this band. These cleavage planes had a dip of more than 65 degrees.

A secondary cleavage plane set was measured with a bearing or azimuth between 75 degrees and 90 degrees. These cleavage planes occur with a dip of more than 50 degrees and largely near 90 degrees. The secondary cleavage plane set extended substantially orthogonal to the principal cleavage plane set. The average bearing of the principal cleavage plane set extends substantially parallel to the Y-axis.

A minor cleavage plane set was also noted with a strike between 100 degrees and 115 degrees and more than 60 degrees dip. This cleavage plane set was not as prominent as the principal and secondary cleavage plane sets and therefore excavations for forming the in situ retort shown in the drawings were not aligned with respect to such minor cleavage plane set.

The orientations of individual cleavage planes within a given cleavage plane set tend to be dispersed relative to one another, rather than all cleavage planes in such a set being parallel to one another. The "dispersion" of a given cleavage plane set is defined as the angular range over which a majority of cleavage planes in such a cleavage plane set are dispersed. Referring to the fracture set diagram illustrated in FIG. 4, the measured dispersion of the principal cleavage plane set was about 40 degrees in strike. The dispersion of the secondary cleavage plane set was about 15 degrees in strike. In the principal cleavage plane set the west-dipping cleavage planes had a lower dispersion than the east-dipping cleavage planes. In the secondary cleavage plane set the individual cleavage planes were about evenly dispersed relative to vertical. The overall dispersion, in dip, of the cleavage planes in the secondary set was substantially similar to that of the cleavage planes in the principal set.

In an embodiment of the present invention, the longer free faces of the unfragemented formation adjacent the slot 24 are aligned with the cleavage plane set having the lower dispersion. The secondary cleavage plane set had the lower dispersion in strike, while the dispersion of the cleavage planes, in dip, for each cleavage plane set was substantially similar. Therefore, the secondary cleavage plane set is considered to have the lower dispersion.

With respect to the fracture set diagram illustrated in FIG. 4, the average bearing of the secondary cleavage plane set is about 82 degrees, so the slot 24 is formed so that its longer side walls 26 extend along an azimuth of 82 degrees.

The slot is formed so that its end walls 28 of unfragmented formation extend generally perpendicular to the length of the side wall 26. Inasmuch as the principal and secondary cleavage plane sets are approximately orthogonal, the end walls 28 of the slot 24 extend generally parallel to cleavage planes in the principal cleavage plane set. Alternatively, the end walls 28 of the slot 24 could extend truly parallel to the average bearing of the principal cleavage plane set, i.e., at a bearing of zero degrees. In this instance the slot would be formed as a parallelogram.

The slot 24 is formed by drilling and blasting techniques described in greater detail in application Ser. No. 790,350 referred to above. Briefly, the slot is formed by excavating a raise having a width substantially the same as that of the slot 24, i.e., the distance between the longer free faces of unfragmented formation on opposite sides of the slot. A balance of unfragmented formation is left within the volume to become the slot between the raise and at least one of the shorter free faces, i.e., the end walls 28, of the slot. The balance of the unfragmented formation within the volume to become the slot is explosively expanded toward the raise.

In a working embodiment, the slot 24 is formed by initially drilling and boring a 4-foot diameter circular raise 30 extending between the base of operation 40 and the access drift 18. As shown in FIG. 2, the raise 30 is bored at the center of the slot being formed. Rows of blasting holes 32 are drilled downwardly from the base of operation on opposite sides of the raise 30. The blasting holes 32 extend from the base of operation of the access drift 18. These blasting holes are illustrated somewhat larger than actual scale in FIG. 3 for clarity. The blasting holes 32 are loaded with explosive up to a level corresponding to the top boundary of the slot being formed. That is, a portion of the blasting holes 32 extending through the sill pillar 22 are stemmed to inhibit breakage above the top boundary of the slot being formed. Such explosive is detonated to explosively expanded formation toward the free face provided by the riase 30 to enlarge the raise to a first rectangular raise 34 illustrated in FIG. 3. The resulting fragmented formation particles are excavated from the access drift 18. The initial raise enlarging can proceed in steps with only one or two blasting holes 32 being loaded with explosive for each round, or several such blasting holes can be loaded with explosive for less than their full length. In either case fragmented formation is excavated between rounds.

Figure 3:
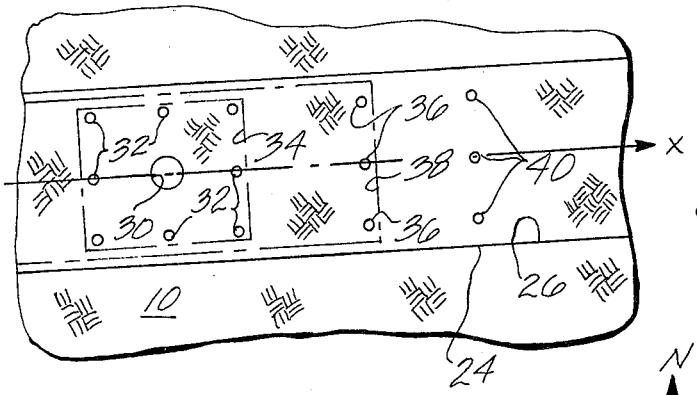
FIG. 3 is a semi-schematic plan view taken within the rectangle 3 of FIG. 2 and showing a blasting pattern for excavating a slot during preparation of an in situ oil shale retort.

Following formation of the first rectangular raise 34, further blasting holes 36 are drilled adjacent the first rectangular raise 34, and the blasting holes are loaded with explosive and detonated to enlarge the first rectangular raise 34 to a longer second rectangular raise 38 illustrated in FIG. 3. The second rectangular raise 38 is enlarged by drilling blasting holes 40 and detonating explosive in such blasting holes to lengthen the second rectangular raise 38 to a further extent. The drilling and blasting sequences are repeated until the length of the slot is enlarged to essentially the full width of the retort being formed.

The outermost band of blasting holes used to form the slot 24 is aligned with the secondary cleavage plane set extending through the formation. That is, the outermost blasting holes extend vertically along a plane parallel to the X-axis shown in FIGS. 2 and 3. Detonation of explosive in such blasting holes forms a slot having substantially even surfaced side walls 26 without large protrusions of unbroken formation, owing to the tendency of the formation to preferentially fracture along cleavage planes in the secondary cleavage plane set. Blasting holes at the ends of the slot are aligned perpendicular to the secondary cleavage plane set. As described above, this causes formation to preferentially fracture substantially along cleavage planes in the principal cleavage plane set to form substantially even surfaced end walls 28 of the slot 24.

Figure 5:
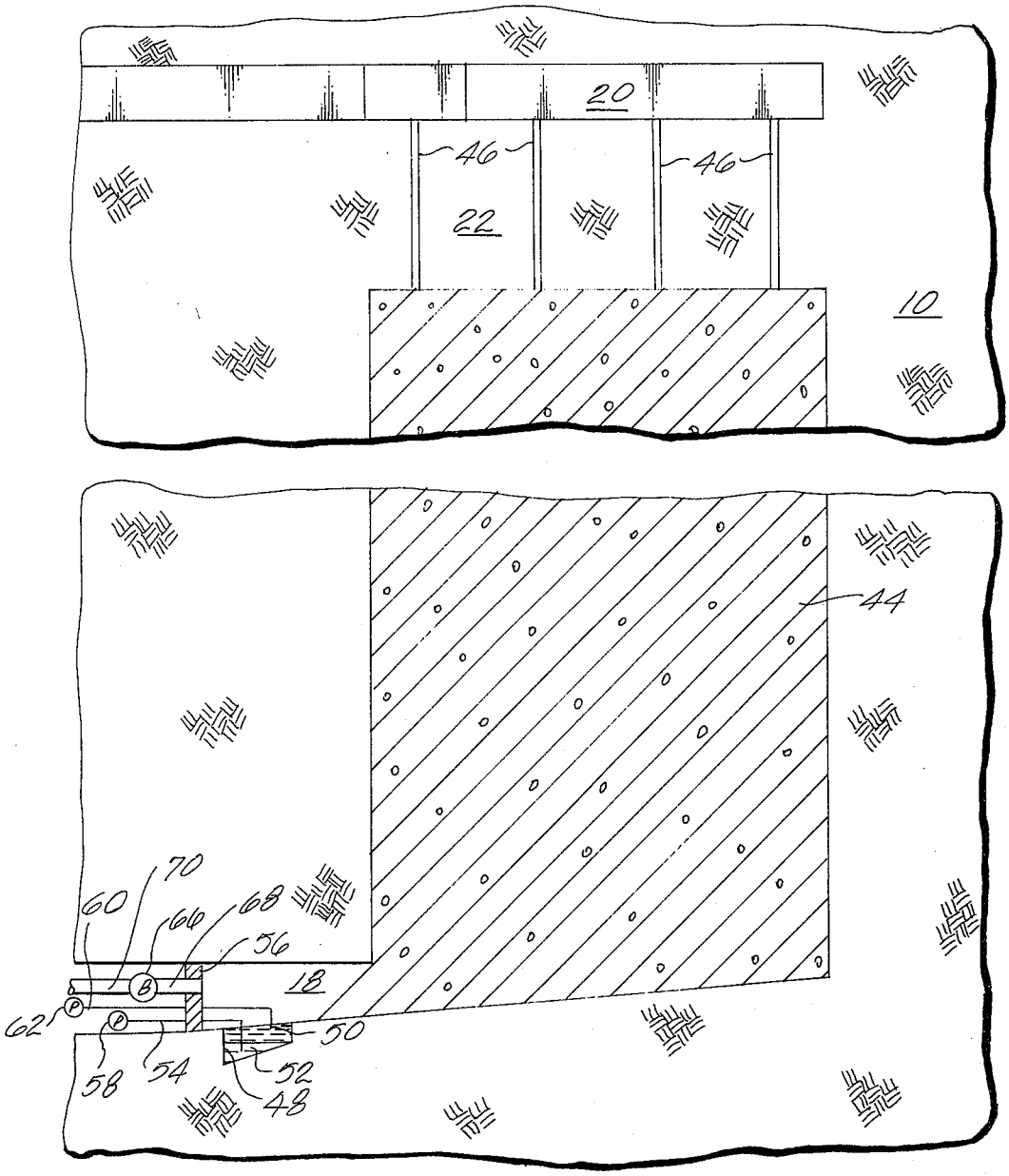
FIG. 5 is a semi-schematic cross-sectional side view showing the in situ oil shale retort of FIG. 1 after explosive expansion of formation in the retort.

Following formation of the slot 24, blasting holes 42 are drilled downwardly from the base of operation 20 through unfragmented formation remaining within the retort site to the lower boundary of the retort being formed. The blasting holes 42 can be arranged, as shown in FIG. 2, with the outermost band of blasting holes extending through the formation substantially parallel to the principal and secondary cleavage plane sets, i.e., parallel to the X-Z and Y-Z planes shown in FIG. 2. Explosive is loaded into the blasting holes 42 and detonated to explosively expand formation toward the free faces provided by the slot 24, forming a fragmented permeable mass of formation particles 44 containing oil shale within the retort site as illustrated in FIG. 5. Drilling and blasting techniques used in forming the fragmented mass 44 are described in greater detail in application Ser. No. 790,350 referred to above.

FIG. 5 illustrates a completed in situ retort in which shale oil is produced from the fragmented mass 44. The particles at the top of the fragmented mass are ignited to establish a combustion zone at the top of the fragmented mass. Air or other oxygen-supplying gas is supplied to the combustion zone from the base of operation 20 through conduits 46 extending downwardly from the base of operation through the sill pillar 22 to the top of the fragmented mass 44. Air or other oxygen-supplying gas introduced to the fragmented mass maintains the combustion zone and advances it downwardly through the fragmented mass. Combustion gas generated in the combustion zone through the fragmented mass on the advancing side of the combustion zone to form a retorting zone where kerogen in the fragmented particles is converted to liquid and gaseous products. As the retorting zone moves down through the fragmented mass, liquid and gaseous products are released from the formation particles. A sump 48 in a portion of the production level access drift 18 beyond the fragmented mass 44 collects liquid products, namely shale oil 50 and water 52, produced during operation of the retort. A water withdrawal line 54 extends from near the bottom of the sump out through a sealed opening (not shown) in a bulkhead 56 sealed across the access drift. The water withdrawal line is connected to a water pump 58. An oil withdrawal line 60 extends from an intermediate level in the sump out through a sealed opening (not shown) in the bulkhead and is connected to an oil pump 62. The oil and water pumps can be operated manually or by automatic controls (not shown) to remove shale oil and water separately from the sump. The inlet of a blower 66 is connected by a conduit 68 to an opening through the bulkhead 56 for withdrawing off gas from the retort. The outlet of the blower 66 delivers off gas from the retort through a conduit 70 to a recovery or disposal system (not shown).

EXAMPLE

Figure 6:
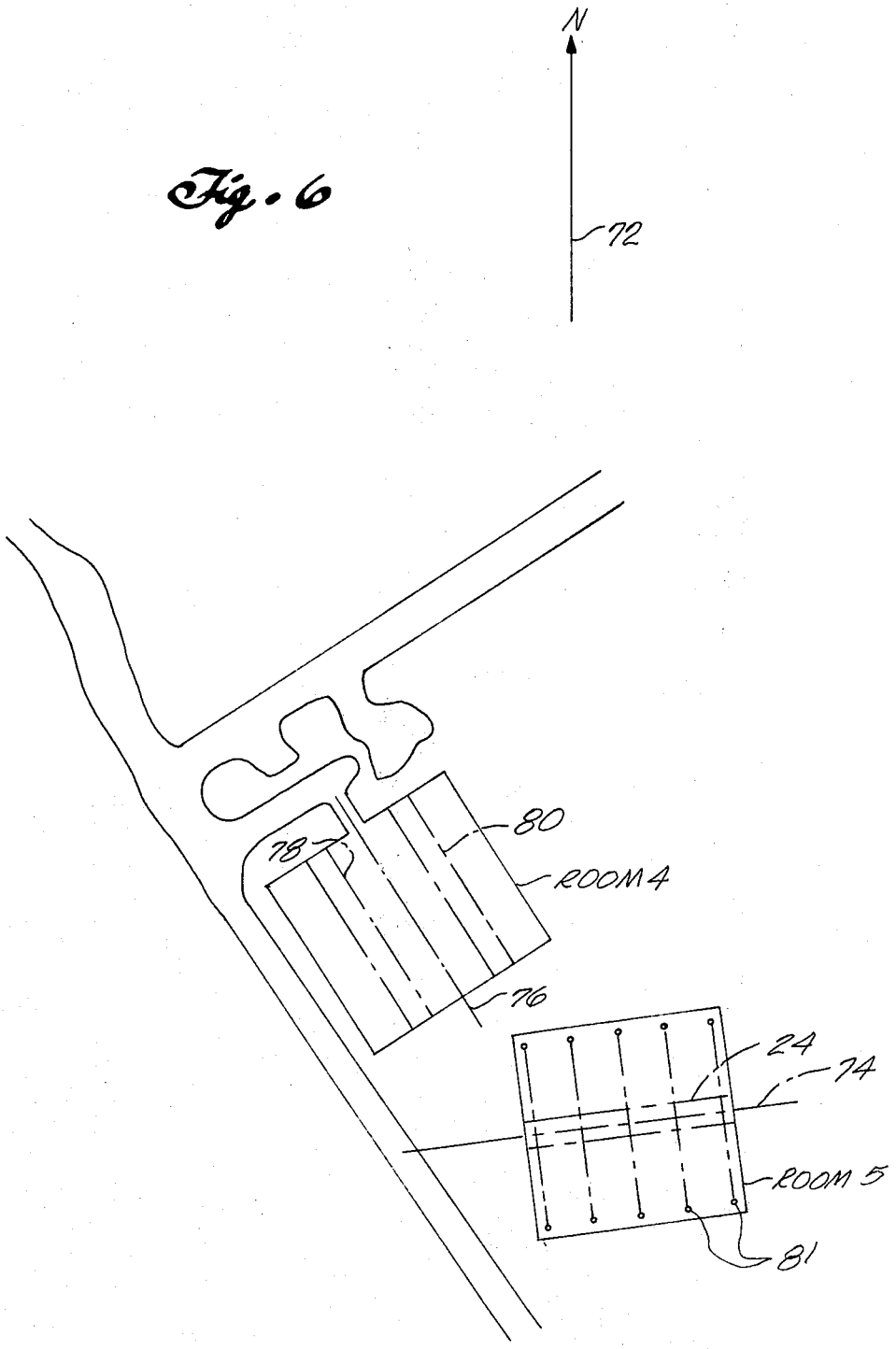
FIG. 6 is a plan view illustrating the relative orientations of a pair of experimental in situ oil shale retorts.

Two in situ oil shale retorts were formed in an experimental project for in situ retorting at Logan Wash in the southwest part of the Piceance Creek Basin north of DeBeque, Colorado. For convenience these two in situ oil shale retorts are referred to below as Room 4 and Room 5, respectively. FIG. 6 illustrates a fragment of a map of underground workings at the Logan Wash site illustrating the relative orientations of Rooms 4 and 5. North is in the direction of the arrow 72 shown in FIG. 6. A line 74 is shown drawn through Room 5 parallel to the vertical slot 24 excavated in the Room 5 retort site. Room 5 was formed according to the description above with respect to FIGS. 1 through 5; that is, the slot 24 was aligned with the secondary cleavage plane set present in the formation. The line 74 is parallel to the length of the slot 24 and has an azimuth or bearing of about 82 degrees. A similar line 76 drawn through Room 4 parallel to vertical slots 78 and 80 has a bearing of about 135 degrees. The cleavage plane sets present in the formation intersected the walls of the slots 78 and 80 for Room 4 at angles appreciably less than right angles.

Two slots, each having a rectangular horizontal cross section of 12 feet by 120 feet, were planned within the retort site for Room 4. The projected cross section of the two slots was 20% of the horizontal cross section of Room 4. That is, it was planned that when formation within the boundaries of the retort being formed as Room 4 was explosively expanded toward the slots to form a fragmented permeable mass of formation particles, the void fraction in the portion expanding toward the slots would be about 20% of the volume of the fragmented mass. Actual construction resulted in an in situ oil shale retort having a fragmented permeable mass of particles with a substantially larger than projected void fraction.

In forming Room 4, a lower level access drift was excavated to a lower portion of the Room 4 site. A void about 130 feet square was excavated at an upper level of the Room 4 site. A large central pillar for roof support was left within the upper level void.

The slots 78 and 80 in the Room 4 site were started by drilling down from the upper level void to the lower level access drift and raise boring to form a four foot diameter circular raise. Fragmented formation particles from forming the raise were excavated through the lower level access drift.

Blasting holes substantially parallel to the raise were then drilled from the upper level void. These blasting holes each had a diameter of four and one-half inches. The blasting holes were loaded with an ammonium nitrate-fuel oil (ANFO) explosive for enlarging the raise and extending the slot. Explosives in three such holes were detonated in a single round for enlarging the raise. A powder factor of over six pounds of ANFO per ton of formation being blasted was used. Fragmented formation particles resulting from the blasting were withdrawn through the access drift at the lower level.

To further enlarge the raise and form a slot, blasting holes were drilled downwardly parallel to the enlarged raise. A row of three holes perpendicular to the width of the slot being formed was detonated in each round with a burden of about ten feet. The powder factor was about two pounds of ANFO per ton of formation being blasted. The fragmented formation particles from blasting were withdrawn through the access drift at the lower level. This drilling and blasting sequence was repeated to enlarge the slots to the full 120-foot width of the retort being formed.

The slots for Room 4 did not maintain their design width, and they continued to widen as the walls of the slots continued to fail after parts of the slot were excavated. Time became important during formation of Room 4 because the walls of the slots continually sloughed off and blasting of the remaining formation in the retort site could not be postponed. Further, because of the fractures extending from the slots into adjacent formation, and the resulting weak rock condition in the walls of the slots, excavation of fragmented particles in the bottoms of the slots could not be completed. Additional slabs of formation would break out of the walls as the level of fragmented particles in the slots was lowered. The principal cleavage plane set intersected the walls of the slots at an acute angle, which aggravated the backbreakage by forming planes of weakness along which the formation was fractured and could fail and slough off in slabs. Fractures aligned with the principal cleavage plane set at an acute angle to the walls of the slots caused wedge-shaped sections of formation to slough off and fall into the slots.

Figure 7:
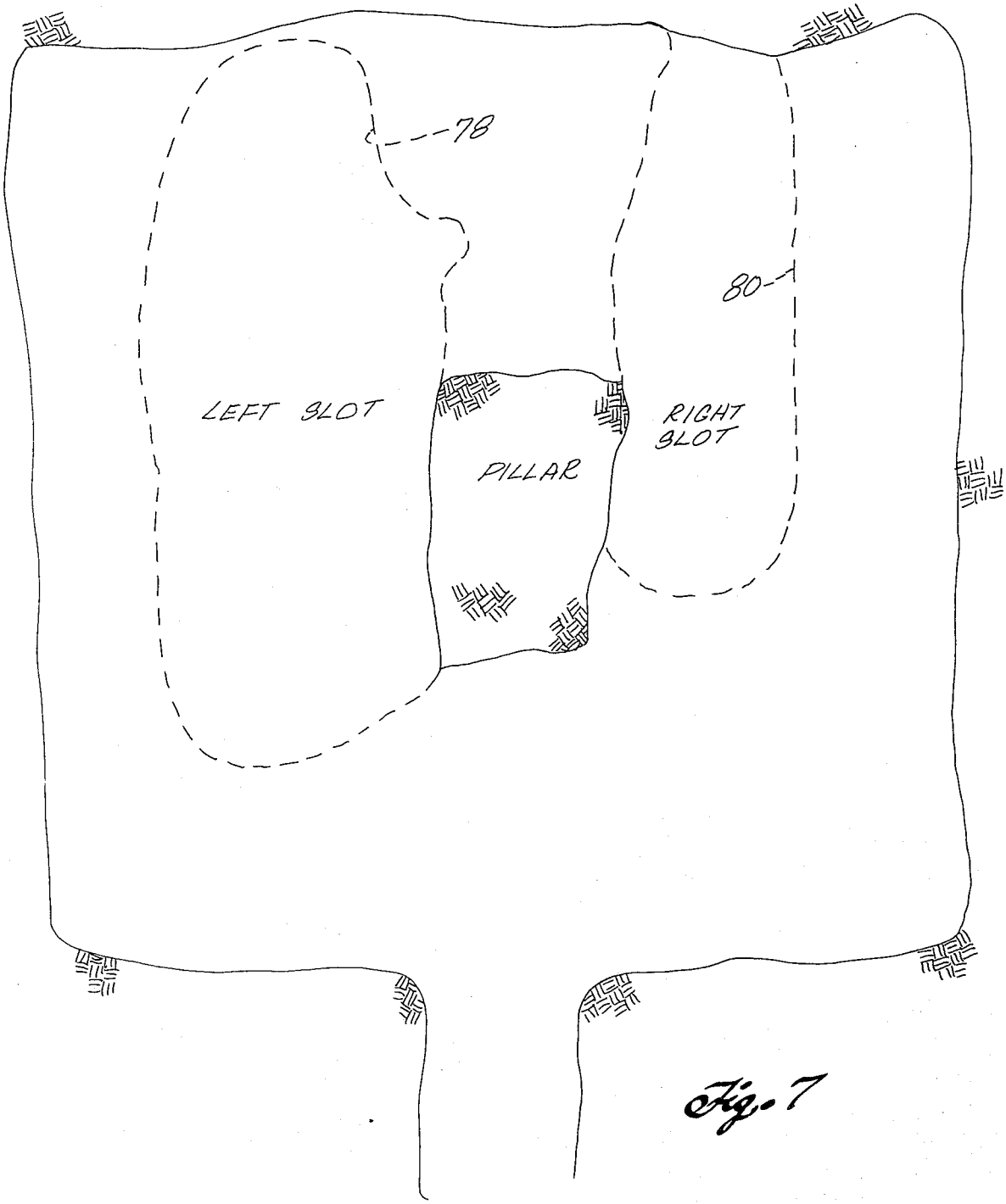
FIG. 7 is a schematic plan view illustrating the estimated size and shape of the right and left slots, following slot formation, at an upper level of an experimental retort being formed.
Figure 8:
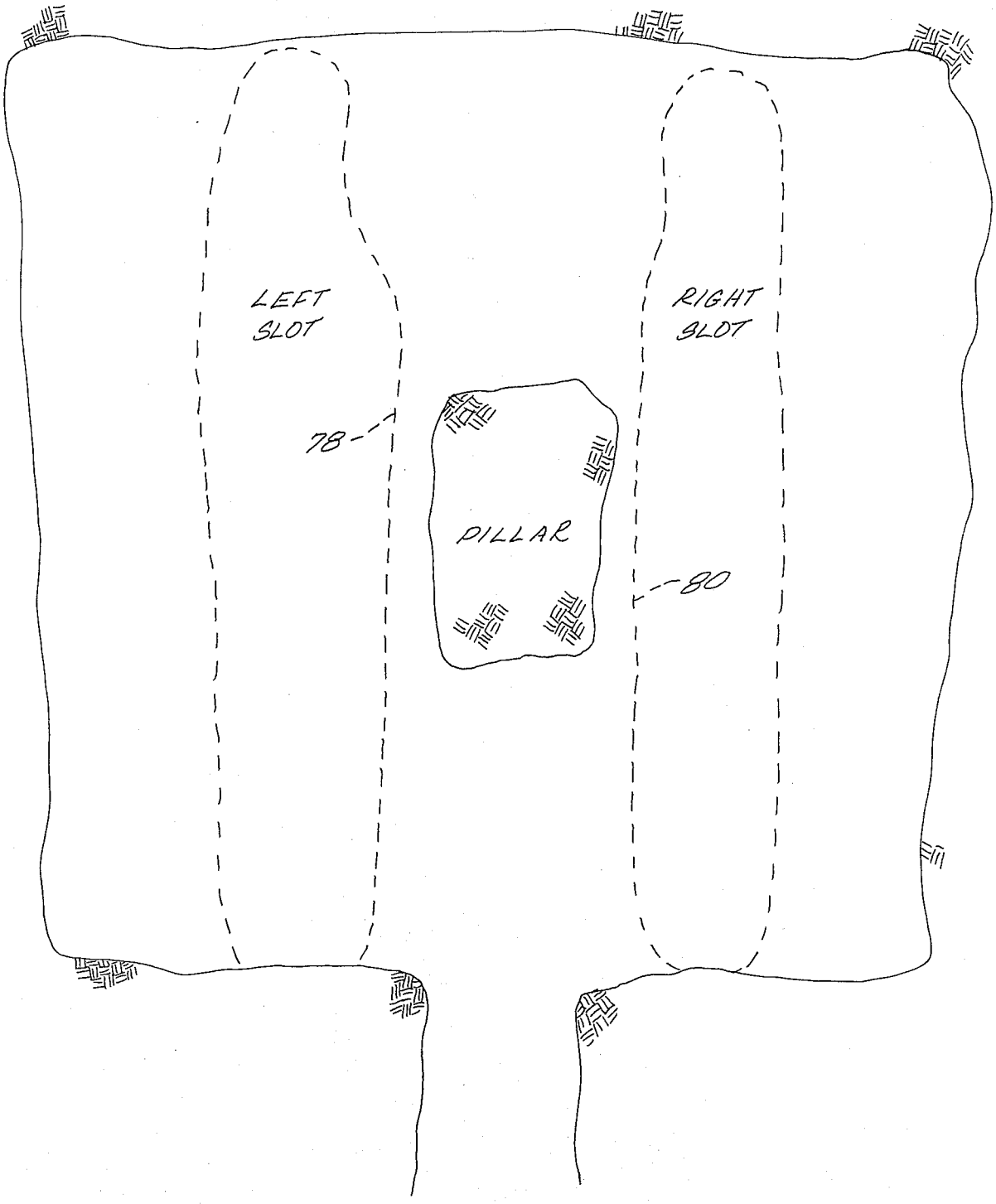
FIG. 8 is a schematic cross-sectional plan view similar to FIG. 7 showing the right and left slots at an intermediate level.
Figure 9:
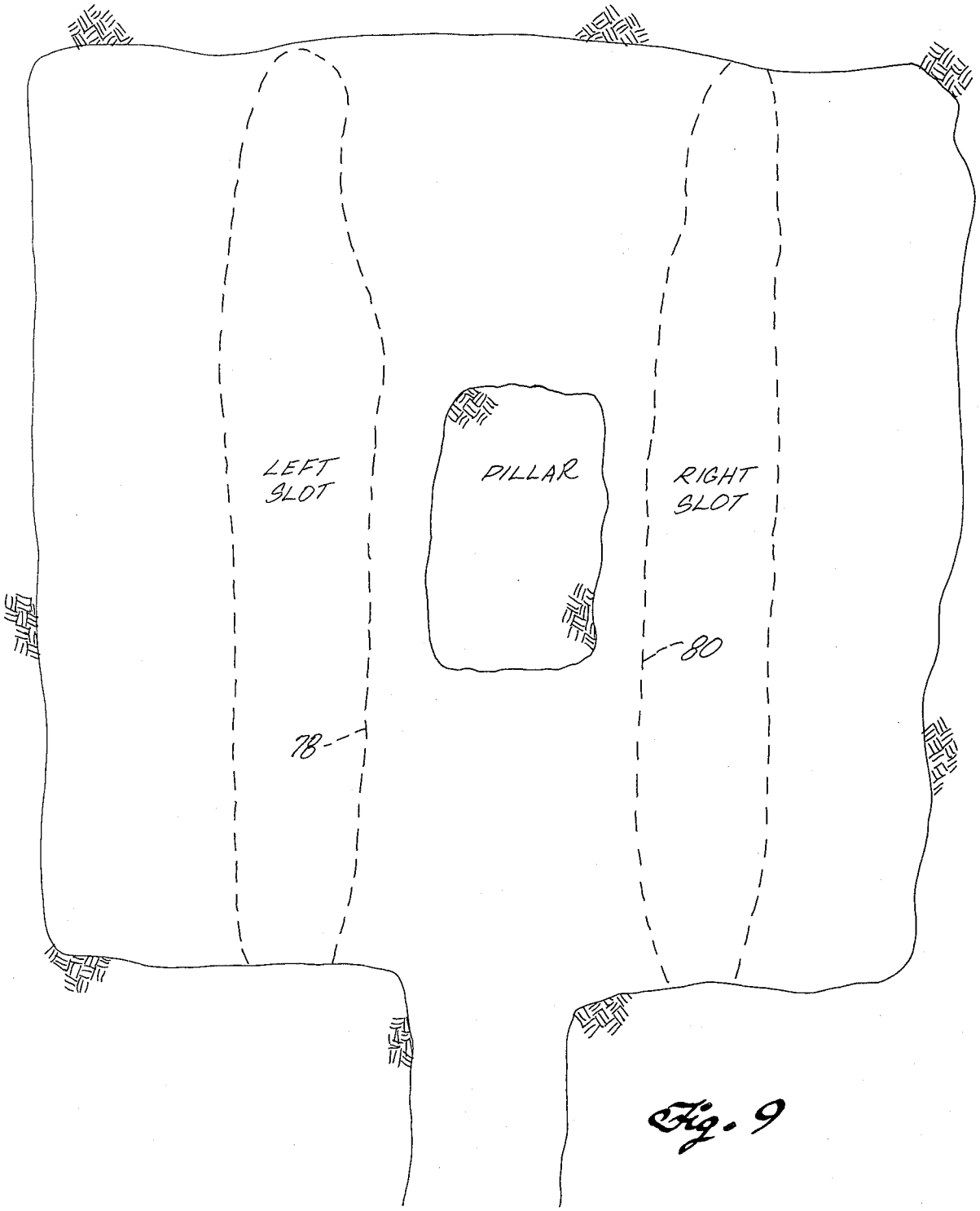
FIG. 9 is a schematic cross-sectional plan view similar to FIG. 7 showing the right and left slots at a lower level.

The final shape of the slots 78 and 80 is illustrated in FIGS. 7, 8 and 9. In each of these illustrations, shapes and sizes of the slots were estimated from long range visual inspection, inasmuch as safety considerations precluded actual measurements. FIG. 7 illustrates the estimated shape and size of the slots at a level about 20 to 30 feet below the floor of the void at the upper level. FIG. 8 illustrates the estimated shape and size of the slots at about 100 to 120 feet below the floor of the upper level void. FIG. 9 illustrates the estimated shape and size of the slots about 160 to 180 feet below the floor of the upper level void. It will be noted that the top of each slot was terminated at a level below the floor of the upper level void in an area near the upper access drift into the void. This left a portion of the floor of the upper level void intact for access by men and equipment.

Fragmentation and distribution of void volume in the fragmented permeable mass after explosive expansion were not considered completely satisfactory. This was at least least partly due to problems in loading explosive into blasting holes which resulted in poor distribution of explosive in the formation to be fragmented.

As described above with respect to FIGS. 1 through 5, Room 5 was oriented with the walls of the single slot 24 substantially parallel to the secondary cleavage plane set, which was approximately normal to the principal cleavage plane set. Thus, the azimuth or bearing of the walls of the slot 24 was about 82 degrees. A top or sill pillar of unfragmented formation about 40 feet thick was left between the top of the slot and the floor of the upper level void which avoided an upper free face adjacent the top of the slot such as that present at the floor of the upper level void in Room 4. As described above, rows of three blasting holes were used for enlarging the Room 5 slot lengthwise in the same general manner as in forming the slots in Room 4. The drill hole diameter for slot blasting in Room 5 was three and $\frac{5}{8}$ inches, thereby minimizing overloading and resultant overbreaking of the remaining rock. The lower portions of the drill holes were loaded with explosive up to about 40 feet below the level of the E-shaped void at the upper level. Thus, the top of the slot was separated from the floor of the upper level void by about 40 feet of unfragmented formation. Additional details of a technique used in forming Room 5 are set forth in U.S. patent application Ser. No. 790,350, filed Apr. 25, 1977, by Ned M. Hutchins and assigned to the assignee of this application.

By aligning the slot in Room 5 with one of the cleavage plane sets in the formation, backbreakage problems were not aggravated and sloughing of rock from the walls was minimized. The slot in Room 5 was not affected significantly by time, as were the slots 78 and 80 in Room 4. The slot in Room 5 stood open for seven months without noticeable change. No substantial problems were encountered in loading explosive in blasting holes 81 for explosive expansion of the remaining formation in Room 5 toward the slot 24. As shown in FIG. 6, the rows of blasting holes 81 were aligned approximately parallel to the free faces of unfragmented formation adjacent the vertical slot, and thus, they were aligned with the vertical cleavage planes extending through the retort site. The outer row of blasting holes defined the vertical sides of the retort formed, and thus, the vertical walls of unfragmented formation at the boundary of the retort were parallel to the vertical cleavage planes. The blasting for explosive expansion went off as scheduled on Dec. 16, 1976.

A primary reason for failure of the walls and consequent widening of slots 78 and 80 in Room 4 is believed to be the misalignment of the walls of the slots with the cleavage planes along which the formation preferentially fractured. Other factors, such as overloading of explosive in the blasting holes for enlarging the slots, and the opening at the top of the slots into the floor of the upper level void, are believed to have had little influence on the failure of the walls and the widening of the slots in Room 4.

The failure of the walls in the Room 4 slots is believed to have been primarily a result of the misalignment of the slots with the widely dispersed principal cleavage plane set existing in the formation where Room 4 was formed. In many types of rock other than oil shale, orientations of individual cleavage planes within a given cleavage plane set are tightly group and exhibit limited angular dispersion of cleavage planes within such a set. It is believed that oil shale (marlstone) is an unusual rock when compared with some other types of rock. It can have an unusually high angular dispersion of individual cleavage planes within a given cleavage plane set when compared with some other types of rock; and as a result, it can exhibit an unusual behavior when fractured during explosive expansion to form a slot or fragmented mass in a retort.

For example, the Green River formation at the Logan Wash site has two major cleavage plane sets having different dispersion characteristics. The principal cleavage plane set, namely, the generally north-south cleavage plane set, has a relatively wide dispersion, in both dip and strike, of individual cleavage planes within the cleavage plane set. The secondary cleavage plane set, namely, the generally east-west cleavage plane set, has a lower dispersion, in strike, than the principal cleavage plane set. A wide dispersion of individual cleavage planes within a given cleavage plane set provides the possibility of intersection between cleavage planes within the same set. Such a wide dispersion also provides the possibility of wedges of formation being formed between the cleavage planes and the vertical side walls of the slot, particularly if the cleavage planes intersect the side walls at angles of 30 degrees or less. The misorientation of the long axis of the slots in Room 4 with respect to the widely dispersed principal cleavage plane set contributed significantly to the instability of the walls of the slots in Room 4. Such instability was further affected adversely by the dispersion of cleavage planes, in dip, on both sides of the vertical direction of the principal cleavage plane set. This resulted in wedge formation between individual cleavage planes of the principal cleavage plane set, as well as between such cleavage planes and the vertical side walls of the slots. Such wedges could slough off into the slots.

The slot 24 in Room 5 was aligned substantially perpendicular to the principal cleavage plane set, inasmuch as the vertical walls of the slot were parallel to the generally east-west, i.e., secondary cleavage plane set. This orientation of the slot resulted in relatively even-surfaced and stable side walls when compared with the slots in Room 4. Since secondary cleavage plane set had relatively low dispersion, few cleavage planes intersected the walls at low angles, and wedges of formation which can slough off were minimized.

There were differences between the conditions under which the Room 4 and Room 5 slots were formed, other than the different orientations with respect to the formation cleavave planes. Such other factors were overloading of explosive in the blasting holes for enlarging the slots of Room 4, and the presence of a free face at the top of the slots in Room 4. These factors are believed to have had much less effect on the failure of the walls and consequent widening of the slots in Room 4, as compared with Room 5. The amount of explosive used in forming the vertical slot for Room 5 was approximately 20% to 40% less per unit quantity of unfragmented formation than the amount used in forming the slots in Room 4. It was thought that overloading of the explosive contributed to the failure of the walls in the Room 4 slots, in that such overloading caused appreciable backbreakage, or overbreak, into the walls of the Room 4 slots, causing fractures to extend from the slot into the formation adjacent the slot. However, from subsequent geological analysis it is believed that the effect of overbreak from the blasting holes is limited to a finite distance, with such rock damage being nominally about five feet into the formation from the blast-formed opening. Such rock damage depth data has been confirmed by test work done in the determination of in situ rock stresses in formationsd containing oil shale. The limit of rock overbreak and spalling in cases not affected by fracture orientation is nominally about five feet. Comparisons of the Room 4 overbreak as compared to Room 5 indicate that the major factor in the failure of the walls in Room 4 was the misalignment of three slots with the cleavage planes. Deterioration of the walls in the Room 4 slots exceeded five feet, indicating that such deterioration was caused by adverse cleavage plane orientations, and not overloading of explosive.

A horizontal free face was present at the top of the Room 4 slots. The slots opened into the floor of the upper level void in Room 4. The top of the vertical slot in Room 5 was confined by a horizontal sill pillar of unfragmented formation present at the top of the slot. It was though that the floor of the upper level void, which provided an additional free face in Room 4, allowed additional fracturing along cleavage planes adjacent the floor of the upper level void. However, subsequent geological analysis has shown that the confining effect of the sill pillar in Room 5 is limited to the width of the vertical slot down the slot from the sill pillar. That is, the effect of the closed top in the slot in Room 5 would protect only the top 15 feet of the slot wall from sloughing. Mid-portions of the vertical slot, which are four to eight times this distance, are unaffected by the effects of end confinement at the top of the slot. Thus, the failure of the walls in the Room 4 slots is attributed to the orientation of the slots relative to the cleavage planes in the formation, and not any effects of a free face present at the top of the slots.

Thus, techniques are provided for forming an in situ retort in a subterranean formation having a principal cleavage plane set intersected by a secondary cleavage plane set. The angular dispersion of cleavage planes within each cleavage plane set is determined for both strike and dip. A slot is excavated within the retort site so that the relatively longer free faces of adjacent unfragmented formation extend essentially parallel to the cleavage plane set having the lower dispersion. By aligning the slot so that its longer free faces are parallel to he cleavage plane set having the lower dispersion, it is believed that more planar walls are formed and that such walls are less subject to sloughing or slabbing while the slot stands open, when compared with a slot aligned with a cleavage plane set having the greater dispersion. It also is believed that aligning the longer free faces of a slot substantially perpendicular to the principal cleavage plane set results in keeping the locus of major cleavage planes in the formation nearly perpendicular to the slots, which enhances stability of the slot.

What is claimed is:

1. A method for recovering liquid and gaseous products from an in situ oil shale retort in a subterranean formation containing oil shale and having a substantially vertically extending first cleavage plane set and a substantially vertically extending second cleavage plane set intersecting the first cleavage plane set, comprising the steps of:

determining the angular dispersion of cleavage planes within the first cleavage plane set and within the second cleavage plane set;

excavating a vertically extending slot in the formation having relatively longer side walls and relatively shorter end walls of unfragmented formation, the longer side walls being substantially aligned with the cleavage plane set having the lower dispersion, leaving a remaining portion of unfragmented formation within boundaries of the in situ retort being formed;

explosively expanding at least a part of the remaining portion of the formation toward the slot to form a fragmented permeable mass of formation particles containing oil shale within the in situ retort; and retorting such a fragmented mass to form such liquid and gaseous products.

2. The method according to claim 1 wherein the slot is excavated by the steps of:

forming a raise having a width essentially the same as the distance between the side walls of the slot, and leaving a balance of unfragmented formation within the volume to become the slot between the raise and at least one of the shorter end walls; and explosively expanding at least a portion of the balance of unfragmented formation toward the raise progressing in a direction parallel to the side walls of the slot being formed.

3. The method according to claim 1 wherein the slot is excavated by the steps of:

placing explosive in the formation in at least one row of blasting holes essentially parallel to the cleavage plane set having the lower dispersion for preferentially fracturing such formation along the cleavage plane set having the lower dispersion; and detonating such explosive to fracture the formation along such a cleavage plane set to form such a slot.

4. The method according to claim 3 in which the explosive in such a row of blasting holes is detonated in separate rounds.

5. The method according to claim 1 wherein said remaining portion of unfragmented formation is explosively expanded by the steps of:

placing explosive in the formation adjacent the boundaries of the in situ retort being formed for preferentially fracturing such formation along cleavage planes extending essentially parallel to said boundaries; and detonating such explosive for fracturing the formation along cleavage planes aligned with such boundaries and explosively expanding such remaining formation toward such a slot to form a fragmented permeable mass of formation particles containing oil shale within such boundaries of the in situ retort.

6. The method according to claim 1 in which the dispersion is determined by measuring the angular orientations, in strike and dip, of a plurality of individual cleavage planes in the first cleavage plane set; measuring the angular orientations, in strike and dip, of a plurality of individual cleavage planes in the second cleavage plane set; and comparing such measurements to determine the cleavage plane set having individual cleavage planes with the lower dispersion of angular orientations, in strike and dip, relative to an average orientation of such individual cleavage planes present within each set.

7. The method according to claim 1 in which the slot is excavated with the relatively shorter end walls of the slot extending substantially perpendicular to the cleavage plane set having the lower dispersion.

8. The method according to claim 1 in which the relatively longer side walls of the slot are aligned with the average orientation of the individual cleavage planes within such a cleavage plane set.

9. A method for forming an in situ oil shale retort in a subterranean formation containing oil shale and having a substantially vertically extending first cleavage plane set and a substantially vertically extending second cleavage plane set approximately orthogonal to the first cleavage plane set, in which the angular dispersion of cleavage planes in the first cleavage plane set is greater than the angular dispersion of cleavage planes in the second cleavage plane set, the in situ retort having boundaries of unfragmented formation and containing a fragmented permeable mass of formation particles containing oil shale, comprising the steps of:

excavating a vertically extending slot in the formation and leaving a remaining portion of unfragmented formation within the boundaries of the in situ retort being formed, the slot having a pair of longer side walls of unfragmented formation substantially parallel to the second cleavage plane set and a pair of shorter side walls substantially parallel to the first cleavage plane set; and explosively expanding at least a part of the remaining portion of the formation toward such a slot for forming a fragmented permeable mass of formation particles containing oil shale in the in situ retort.

10. The method according to claim 9 including:

drilling a plurality of elongated blasting holes into said remaining portion of the formation, said blasting holes being aligned with the first and second cleavage plane sets for preferentially fracturing the formation to form side boundaries of the in situ retort aligned with the first and second cleavage plane sets;

loading such blasting holes with explosive; and detonating such explosive for fragmenting and expanding the remaining portion of the formation to form said in situ retort having side boundaries aligned with the first and second cleavage plane sets.

11. A method of forming an in situ oil shale retort in a subterranean formation containing oil shale and having a substantially vertically extending first cleavage plane set and a substantially vertically extending second cleavage plane set intersecting the first cleavage plane set, in which the angular dispersion of cleavage planes in the first cleavage plane set is greater than the angular dispersion of cleavage planes in the second cleavage plane set, comprising the steps of:

excavating a portion of the formation to form a vertically extending slot having relatively longer side walls extending generally parallel to the cleavage planes in the second cleavage plane set and relatively shorter end walls extending generally perpendicular to the cleavage planes in the first cleavage plane set, leaving a remaining portion of unfragmented formation within boundaries of the in situ retort being formed; and explosively expanding at least a part of the remaining portion of the formation toward the slot to form a fragmented permeable means of formation particles containing oil shale within the boundaries of the in situ retort.

12. A method of forming an in situ oil shale retort in a subterranean formation containing oil shale and having a substantially vertically extending principal cleavage plane set and a substantially vertically extending secondary cleavage plane set approximately orthogonal to the principal cleavage plane set, said in situ retort having boundaries of unfragmented formation and containing a fragmented permeable mass of formation particles containing oil shale comprising the steps of:

excavating a vertically extending slot in the formation and leaving a remaining portion of unfragmented formation within the boundaries of the in situ retort being formed, such a slot having a pair of long side walls of unfragmented formation defining free faces substantially parallel to the secondary cleavage plane set and a pair of shorter side walls substantially parallel to the principal cleavage plane set; and explosively expanding at least a part of said remaining portion toward such a free face for forming a fragmented permeable mass of formation particles in the in situ retort.

13. The method according to claim 12 wherein the slot is excavated by the steps of:

forming a raise having a width essentially the same as the width of the slot between the longer free faces, and leaving a balance of unfragmented formation within the volume to become the slot between the raise and at least one of the shorter free faces; and explosively expanding at least a portion of the balance of unfragmented formation toward the raise progressing in a direction parallel to the length of the slot being formed.

14. The method according to claim 12 wherein the slot is excavated by the steps of placing explosive in such formation in at least one row of blasting holes essentially parallel to the secondary cleavage plane set for preferentially fracturing such formation along the cleavage planes in the secondary cleavage plane set; and detonating such explosive to fracture the formation along such cleavage planes to form such a slot.

15. The method according to claim 14 in which the explosive in such a row of blasting holes is detonated in separate rounds.

16. The method according to claim 12 wherein such remaining portion of unfragmented formation is explosively expanded by the steps of:

placing explosive in the formation adjacent side walls of the in situ retort being formed for preferentially fracturing the formation along the cleavage planes extending essentially parallel to the secondary cleavage plane set and essentially perpendicular to the principal cleavage plane set; and detonating such explosive for fracturing the formation along such principal and secondary cleavage plane sets and explosively expanding such remaining formation toward such a slot to form an in situ oil shale retort having side walls of unfragmented formation aligned with the principal and secondary cleavage plane sets and containing a fragmented permeable mass of formation particles containing oil shale.

17. The method according to claim 12 in which he cleavage planes within the secondary cleavage plane set have a lower angular dispersion than the cleavage planes within the principal cleavage plane set.

18. A method for forming an in situ oil shale retort in a subterranean formation containing oil shale and having a substantially vertically extending principal cleavage plane set and a substantially vertically extending secondary cleavage plane set intersecting the principal cleavage plane set, comprising the steps of:

excavating a portion of the formation to form a vertically extending slot having relatively longer side walls aligned with the secondary cleavage plane set and relatively shorter end walls aligned with the principal cleavage plane set, and leaving a remaining portion of unfragmented formation within boundaries of the in situ retort being formed; and explosively expanding at least a part of the remaining formation toward the slot to form a fragmented permeable mass of formation particles containing oil shale in the in situ retort.

19. The method according to claim 18 including:

drilling a plurality of elongated blasting holes into said remaining portion of the formation, said blasting holes being aligned with the principal and secondary cleavage plane sets for preferentially fracturing the formation to form side boundaries of the in situ retort aligned with the principal and secondary cleavage plane sets;

loading such blasting holes with explosive; and detonating such explosive for fragmenting and expanding the remaining portion of the formation to form said in situ retort having side boundaries aligned with such principal and secondary cleavage planes.

20. The method according to claim 18 in which the cleavage planes in the secondary cleavage plane set have a lower dispersion than the cleavage planes within the principal cleavage plane set.

21. In a method for forming an in situ oil shale retort in a subterranean formation containing oil shale and having a substantially vertically extending principal cleavage plane set and a substantialy vertically extending secondary cleavage plane set intersecting the principal cleavage plane set, the improvement which comprises the steps of:

excavating a portion of the formation to form a vertically extending slot having relatively longer side walls and relatively shorter end walls of unfragmented formation, the formation being excavated so that the relatively longer side walls of the slot are aligned with the secondary cleavage plane set, leaving a remaining portion of unfragmented formation within boundaries of the in situ retort being formed; and explosively expanding at least a part of the remaining formation toward the slot to form a fragmented permeable mass of formation particles containing oil shale in the in situ retort.

22. In a method of forming an in situ oil shale retort in a subterranean formation containing oil shale and having a substantially vertically extending first cleavage plane set and a substantially vertically extending second cleavage plane set intersecting the first cleavage plane set, in which the angular dispersion of cleavage planes in the first cleavage plane set is greater than the angular dispersion of cleavage planes in the second cleavage plane set, the improvements comprising the steps of:

excavating a portion of the formation to form a vertically extending slot having relatively longer side walls and relatively shorter end walls of unfragmented formation, the formation being excavated so that the side walls of the slot extend generally parallel to the cleavage planes in the second cleavage plane set, leaving a remaining portion of unfragmented formation within boundaries of the in situ retort being formed; and explosively expanding at least a part of the remaining portion of the formation toward the slot to form a fragmented permeable mass of formation particles containing oil shale within the boundaries of the in situ retort.

* * * * *